US006605567B1

(12) United States Patent
Sproviero et al.

(10) Patent No.: US 6,605,567 B1
(45) Date of Patent: Aug. 12, 2003

(54) PRINT MEDIA TRANSPARENCY

(75) Inventors: Mike Sproviero, Poway, CA (US); Fung-Sun Fei, Poway, CA (US); Michelle Mesias, Dallas, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/577,748

(22) Filed: May 23, 2000

(51) Int. Cl.[7] ..... B41M 5/035; B41M 5/38

(52) U.S. Cl. ..... 503/227; 427/152; 427/256; 428/32.11

(58) Field of Search ..... 428/195, 32.11; 503/227; 427/152, 256

(56) References Cited

U.S. PATENT DOCUMENTS 5,612,281 A * 3/1997 Kobayashi et al. ..... 503/227

5,670,448 A * 9/1997 Kometani ..... 503/227

* cited by examiner

*Primary Examiner*—B. Hamilton Hess

(57) ABSTRACT

A transparency for receiving images generated by a printing device wherein the transparency includes a clear base film substrate. The substrate includes also a pair of surfaces wherein an inkjet receptive coating is disposed on one of the pair of surfaces and a laser receptive coating is disposed on another one of the pair of surfaces. The transparency includes at least one edge having disposed adjacent thereto a control strip having indicia for generating a signal indicative of which of said pair of surfaces is in position for printing by the printing device. The control strip can be disposed on the substrate surface that includes the inkjet receptive coating or on the substrate surface that includes the laser receptive coating. The invention includes a method of constructing a transparency utilizable in both inkjet and laser printers and a method of substantially eliminating curling in a printed transparency.

13 Claims, 1 Drawing Sheet

PRINT MEDIA TRANSPARENCY

BACKGROUND OF THE INVENTION

The present invention relates generally to media used in printers and, more particularly, to media utilized to print transparencies.

Printers of various types are virtually universally known. They are used daily in thousands of business organizations, university campuses and even homes. While printers are manufactured by a number of competing business entities, the printers themselves often fall into one of two categories.

The lower cost and familiar printer is the inkjet printer that utilizes carriage borne cartridges to eject ink onto print media. Such media are often papers but, in some cases, may be transparent sheets for use in presentations utilizing overhead projectors.

A more expensive but very popular printer is the laser printer. This printer is capable of faithful reproductions, in black and white and color, on a variety of media, including transparent sheets.

Generally, media include coatings that are specific for the type of printer for which the media are to be used. Thus, media intended for use in a laser printer will have a coating specific for that type of printer and will not produce an acceptable result in an inkjet printer.

Because of the specificity of coatings, manufacturers and retailers of print media must deal with supplies of two types of media. This is true, of course, in the case of transparent media. At present, transparent media, generally in the form of clear polyester sheets, are manufactured and sold having either a laser receptive coating or an inkjet receptive coating. The necessity of stocking two types of transparencies increases retailers' overhead since shelf space must be provided for both types. Costs are increased also because of customer returns when, as a result of confusion between the two media types, the customer buys, and subsequently returns, an unwanted type of transparency.

In addition, many offices now have both inkjet and laser printers. Thus, space must be provided for the two types of transparencies and supplies must be monitored to ensure that adequate supplies of both are available. In addition, media waste occurs when, through inadvertence, an incompatible type of media is used in a printer.

In view of the foregoing, it would be desirable to have an invention that would eliminate substantially customer confusion while lowering retailers' costs. Desirably, such an invention would provide added value by reducing retail store shelf space, and office storage space, while substantially eliminating a source of customer confusion.

While the discussion above focuses on the commercial aspects of transparency use, another prior art limitation warrants consideration. It is well known that many transparencies trend to curl upon completion of the printing process or when placed on an overhead projector for presentations. Curling can be so significant a problem that some transparency manufacturers produce such media with a receiving layer on one side and an anti-curling layer on the other side. The addition of the anti-curling layer, of course, adds an extra step in the manufacturing process and increases product cost. With this in view, it would be highly desirable to have an invention that would produce the benefits set forth above while simultaneously eliminating a need for transparency anti-curling coatings.

DISCLOSURE OF THE INVENTION

According to the present invention, there is provided a transparency for receiving images generated by a printing device wherein the transparency includes a clear base film substrate. The substrate includes also a pair of surfaces wherein an inkjet receptive coating is disposed on one of the pair of surfaces and a laser receptive coating is disposed on another one of the pair of surfaces. The transparency includes at least one edge having disposed adjacent thereto a control strip having indicia for generating a signal indicative of which of said pair of surfaces is in position for printing by the printing device. The control strip can be disposed on the substrate surface that includes the inkjet receptive coating or on the substrate surface that includes the laser receptive coating. The invention includes a method of constructing a transparency utilizable in both inkjet and laser printers and a method of substantially eliminating curling in a printed transparency.

The present invention affords several advantages. For example, in return for a very small increase in manufacturing costs, the invention substantially reduces the overhead of the retailer since it conserves valuable shelf space and reduces accounting tasks as a single multi-purpose transparency replaces two. In addition, the present invention reduces the volume of customer returns since the likelihood of purchase of an incorrect type of transparency is reduced. Finally, an advantage derived from the invention is a marked diminution in curling of the transparency after it has undergone the printing process and during use in an overhead projector. This unexpected benefit enables the manufacturer to eliminate the anti-curling coating, thereby conserving costs.

In summary, a transparency embodying the invention is inexpensive to manufacture, reliable in performance and acceptable to the consuming public.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
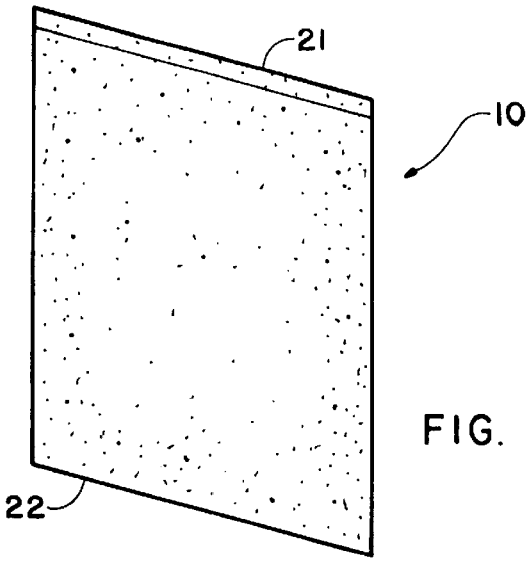
FIG. 1 is a perspective view of a transparency that is constructed according to the present invention.
Figure 2:
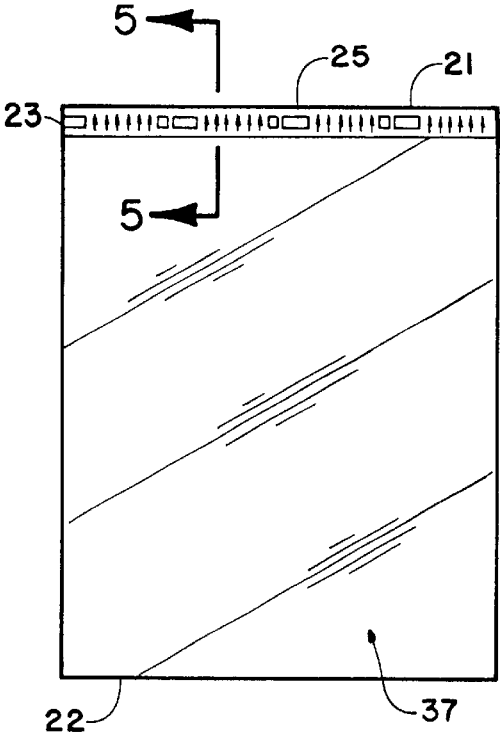
FIG. 2 is an elevational view showing one surface of the transparency of FIG. 1.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to embraced within their scope.

In the following detailed description and in the several figures of the drawings, like elements are identified with like reference numerals.

Figure 3:
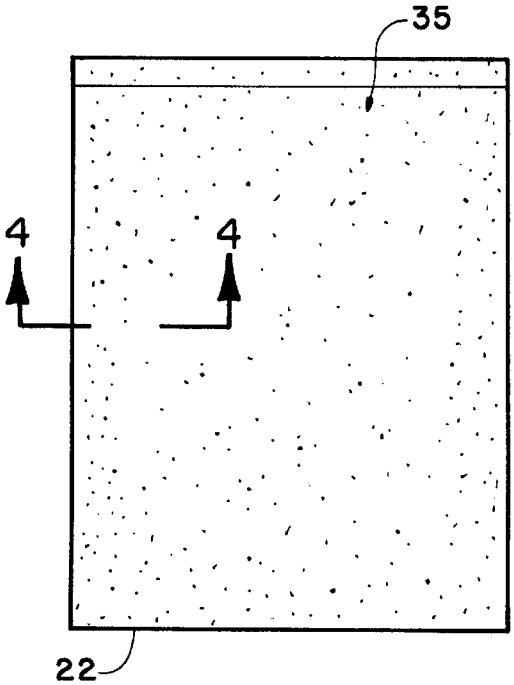
FIG. 3 is an elevational view showing another surface of the transparency of FIG. 1.
Figure 4:
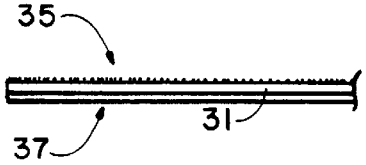
FIG. 4 is a view taken along the line 4—4 of FIG. 3.
Figure 5:
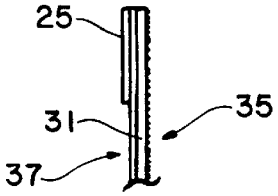
FIG. 5 is a view taken along the line 5—5 of FIG. 2

Referring now to the drawings, there is shown a novel transparency 10 that is constructed according to the present invention. The transparency 10 is comprised of a clear polyester sheet, having a rectangular shape that is often about letter size. It includes a transparent substrate 31 having on one surface a laser receptive coating, generally indicated by the reference numeral 35, and on the opposite surface, an inkjet receptive coating generally indicated by the reference numeral 37. As best shown in FIGS. 3 and 4, the substrate 31 is substantially thicker than the combined thicknesses of the coatings 35 and 37.

For convenience, the transparency 10 may be regarded as having a leading edge 21 and a trailing edge 22. During use, the leading edge 21 is fed first into a printer (not shown). A control strip 25 is mounted to the substrate 31 adjacent the leading edge 21. The control strip 25 includes indicia, such as the indicia 23, which can be read by an optical sensor within the printer (not shown) for conveying information, such as media type and orientation, to the printer operator. In addition to being machine readable, the control strip 25 can be also human readable, having information regarding media orientation that is helpful to the operator. The control strip 25 can be mounted on either side of the transparency 10.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A transparency for receiving images generated by a printing device, comprising:

a clear base film substrate, said substrate including a pair of surfaces;

an inkjet receptive coating disposed on one of said pair of surfaces, the ink-jet receptive coating not being suitable for use as a laser receptive coating; and a laser receptive coating disposed on another one of said pair of surfaces, the laser receptive coating not being suitable for use as an inkjet receptive coating.

2. The transparency according to claim 1, wherein said substrate includes at least one edge and a control strip disposed adjacent said at least one edge.

3. The transparency according to claim 2, wherein said control strip includes indicia for generating a signal indicative of which of said pair of said surfaces is in position for printing by said printing device.

4. The transparency according to claim 2, wherein said control strip includes indicia in human readable form for aiding a printer operator in orienting said transparency with respect to said printing device.

5. The transparency according to claim 2, wherein said control strip is disposed on the substrate surface that includes said inkjet receptive coating.

6. The transparency according to claim 2, wherein said control strip is disposed on the substrate surface that includes said laser receptive coating.

7. The transparency according to claim 1, wherein said substrate has a thickness substantially greater than the combined thicknesses of said coatings.

8. A method of constructing a transparency utilizable in inkjet printers and in laser printers comprising the steps of:

providing a clear base film substrate, said substrate including a pair of surfaces;

applying an inkjet receptive coating to one of said pair of surfaces, the ink-jet receptive coating not being suitable for use as a laser receptive coating, and applying a laser receptive coating to another one of said pair of surfaces, the laser receptive coating not being suitable for use as an inkjet receptive coating.

9. The method according to claim 8, including the steps of locating an edge of said substrate and disposing a control strip adjacent said edge.

10. The method according to claim 9, including a step of disposing said control strip on the substrate surface that includes said inkjet receptive coating.

11. The method according to claim 9, including a step of disposing said control strip on the substrate surface that includes said laser receptive coating.

12. The method according to claim 8, including the step of applying indicia to said control strip for generating a signal indicative of which of said pair of surfaces is in position for printing by said printing device.

13. A method of reducing curling of a printed transparency, comprising the steps of:

providing a clear base film substrate, said substrate including a pair of surfaces;

applying an inkjet receptive coating to one of said pair of surfaces, the ink-jet receptive coating not being suitable for use as a laser receptive coating; and applying a laser receptive coating to another one of said pair of surfaces to produce thereby a transparency resistive to curling, the laser receptive coating not being suitable for use as an inkjet receptive coating.

* * * * *